US008857615B1

(12) United States Patent
LaMasney

(10) Patent No.: US 8,857,615 B1
(45) **Date of Patent: *Oct. 14, 2014**

(54) STANDING DELI CONTAINER

(71) Applicant: Plastic Ingenuity, Inc., Cross Plains, WI (US)

(72) Inventor: Robert G. LaMasney, Cross Plains, WI (US)

(73) Assignee: Plastic Ingenuity, Inc., Cross Plains, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/043,584

(22) Filed: Oct. 1, 2013

Related U.S. Application Data

(63) Continuation of application No. 12/503,839, filed on Jul. 16, 2009, now Pat. No. 8,573,400.

(51) Int. Cl.
*B65D 21/00* (2006.01)
*B65D 21/02* (2006.01)

(52) U.S. Cl.
CPC ..... *B65D 21/0233* (2013.01); *Y10S 206/821* (2013.01)
USPC ..... 206/508; 220/781; 220/380; 206/821

(58) Field of Classification Search
USPC ..... 220/23.6, 406, 23.86, 23.83, 781, 380, 220/4.26, 4.27; 206/503, 504, 505, 506, 206/507, 508, 509
See application file for complete search history.

(56) References Cited

U.S. PATENT DOCUMENTS

| | | | | |
|---|---|---|---|---|
| 6,889,837 | B2 * | 5/2005 | Soehnlen et al. | 206/459.5 |
| 2006/0032858 | A1 * | 2/2006 | Lee et al. | 220/793 |
| 2006/0124654 | A1 * | 6/2006 | Cai | 220/780 |
| 2006/0186013 | A1 * | 8/2006 | Hubert | 206/508 |
| 2006/0186014 | A1 * | 8/2006 | Ramanujam et al. | 206/508 |

* cited by examiner

*Primary Examiner* — Robert J Hicks
*Assistant Examiner* — Kareen Rush
(74) *Attorney, Agent, or Firm* — Rick L. Abegglen

(57) ABSTRACT

A thermoformed container system with a tray and a lid mounted on the tray, that includes special structures to help two or more containers to stand on their bottom edges when nested together, even though each individual container would be too unstable to stand in isolation. Alternative embodiments of the invention include a product case pack comprising at least two containers with product inside each container, and a method of retail sales display of two or more containers, where the containers are adapted to stand on their bottom edges when nested together.

17 Claims, 19 Drawing Sheets

STANDING DELI CONTAINER

CROSS REFERENCE TO RELATED APPLICATIONS

This application is a continuation of application Ser. No. 12/503,839 filed Jul. 16, 2009, the disclosure of which is incorporated by reference.

FIELD OF THE INVENTION

This invention relates generally to the field of containers. More particularly, the present invention relates to thermoformed containers having features that enhance the container's ability to stand erect when multiple containers are displayed together for sale.

BACKGROUND OF THE INVENTION

Sales and display space in a store is a valuable resource, especially in high traffic areas such as end caps or in expensive refrigerated shelving in the meat or dairy department of a grocery store. Effective utilization of the available sales and display space in a store can make the difference between profit and loss, when that space is used to maximize planned or impulse purchases, to provide for the right levels of inventory, and to offer a wider variety of product choices.

In a retail sales environment, product containers often have an appearance meant to attract the attention of consumers, and they often bear information and messages meant to motivate consumers to make a purchase. It follows that the greater the usable display area available on the surface of a particular product container, the larger the billboard on which to display an attractive appearance and convey messages to potential purchasers. Consequently, all other things being equal, a container with more usable display space would be preferred over a container with less usable display space on its surface.

Another practical problem in a retail environment is to maintain the right amount of inventory to meet demand. Too much space allocated to inventory of one particular product is undesirable when that space could be better used to offer a wider variety of products, or when that inventory is not turning over quickly enough. Too little space for inventory of one particular product is undesirable if it results in lost sales when a product is out of stock, or if the lack of space requires too-frequent inventory replenishment. Consequently, a container that allows more of a particular product to be stored in a given volume of sales and display space would be preferred over a container that makes less efficient use of that space, especially when that space is at a premium.

Thermoformed plastic containers are well known as inexpensive and highly customizable containers for the sale of a wide variety of products, everything from cell phones to deli meats. Thermoformed plastic containers are typically transparent and rigid, so they can give a consumer the ability to examine a product closely. They can be made tamper-resistant, to reduce the risk that the product could be damaged or contaminated. They are typically lightweight, and can be efficiently stored or shipped together in a nested fashion. It is easy to include product information and cosmetic features in these types of containers, for example with stickers or cards glued to the outside of the containers, with embossing molded into the containers, or with paper inserts inside the containers.

For these and other reasons, thermoformed plastic containers are often preferred over other available options for product containers, such as cardboard or metal boxes, bags, metal cans, or paper cartons. However, for some packaging applications, for example sales of products in refrigerated deli meat sections of a grocery store, thermoformed plastic containers have not gained market share compared to these other available options. What is needed is a thermoformed container system that can stand up to maximize usable available display space on its surface and that can nest together to maximize storage density of inventory in a given volume of sales and display space.

SUMMARY OF THE INVENTION

A first embodiment of the invention is a thermoformed container system using thermoformed plastic containers, each container having a tray and a lid mounted on the tray. The tray and lid include special structures to help two or more containers to stand on their bottom edges when nested together, even though each individual container would be too unstable to stand in isolation. In a container system according to this first embodiment of the invention, when two or more containers are nested together with the lid of the rearward container coupled with the tray of the forward container, a first engagement structure on the tray in front exerts a downward force met with an equal but opposite upward force from a second engagement structure on the lid behind it, resulting in an equilibrium of forces that helps the two or more nested containers to prop themselves up and stand vertically on their bottom edges.

A second embodiment of the invention is a product case pack comprising at least two containers, each container including a tray and a lid mounted on the tray, and with some kind of product inside the container. The containers are adapted to be nested together, with the lid of the rearward container nested with the tray of the forward container. The containers include a first engagement structure on the tray and a second engagement structure on the lid, wherein the first engagement structure on the forward tray exerts a downward force met by an upward force from the second engagement structure on the lid behind it when the nested containers are positioned together to stand vertically on their bottom edges.

A third embodiment of the invention is a retail sales display method comprising providing a sales and display space having a shelf area, providing at least two containers, each having a tray, a lid mounted on the tray, and some kind of product inside, wherein the containers include a first engagement structure on the tray and a second engagement structure on the lid, nesting the containers together with the lid of the rearward container coupled with the tray of the forward container, and positioning the containers to stand vertically on their bottom edges, whereby the first engagement structure on the forward tray can exert a downward force met by an upward force from the second engagement structure on the rearward lid to enhance the stability of the plurality of containers standing together.

Further objects, features, and advantages of the invention will be apparent from the following detailed description when taken in conjunction with the accompanying drawings.

DETAILED DESCRIPTION OF THE INVENTION

FIGS. 1A-1F provide various views of an exemplary tray 20 for a container according to the invention. For purposes of illustration and not as a limitation, the names of the walls of the tray 20 (e.g. top, side, bottom, rear, etc.) assume that the tray 20 is positioned in an upright standing position with the cavity side of the tray facing the observer and with the bottom wall 22 (the wall labeled "BRAND" in FIG. 1A) facing down.

Figure 7:
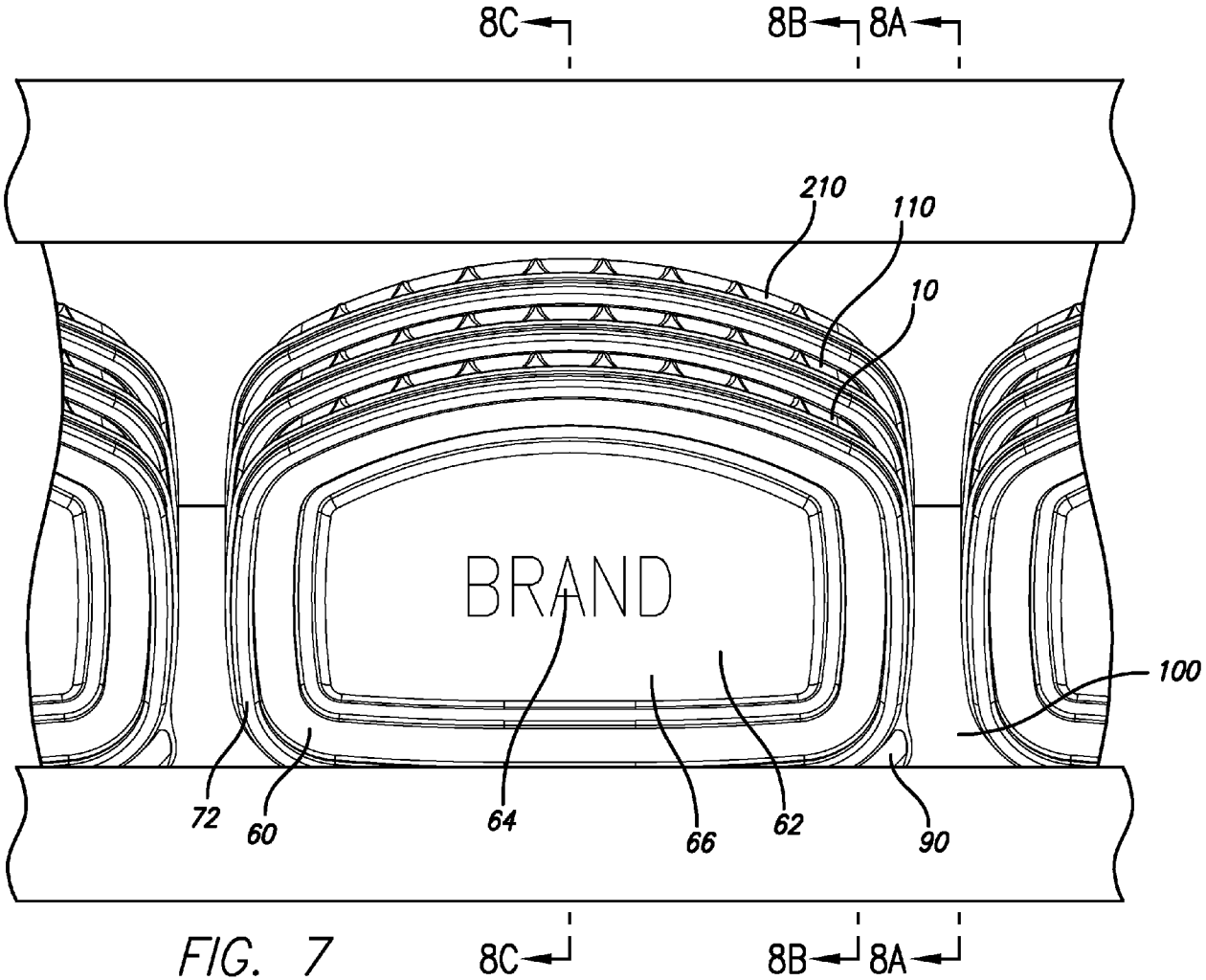
FIG. 7 is a perspective view of three containers according to the invention, nested together and standing in a sales and display area, for example on a refrigerated shelf in a grocery store.

In other words, the names assume the tray 20 is viewed as in FIG. 7. In that orientation, the tray 20 can be said to include a bottom wall 22, two side walls 28, a top wall 30, and a rear wall 32 that surround an interior cavity 36.

The tray 20 includes a first engagement structure 26. In the exemplary tray 20, the first engagement structure 26 is located on the bottom rear corner 24 where the rear wall 32 and bottom wall 22 meet. However, this particular location is not required and the first engagement structure 26 could be located somewhere else, for example a side wall 28 or rear wall 32. FIGS. 1A, 1B, 1F, 2A, and 8C perhaps best illustrate the exemplary first engagement structure 26.

Figure 1A:
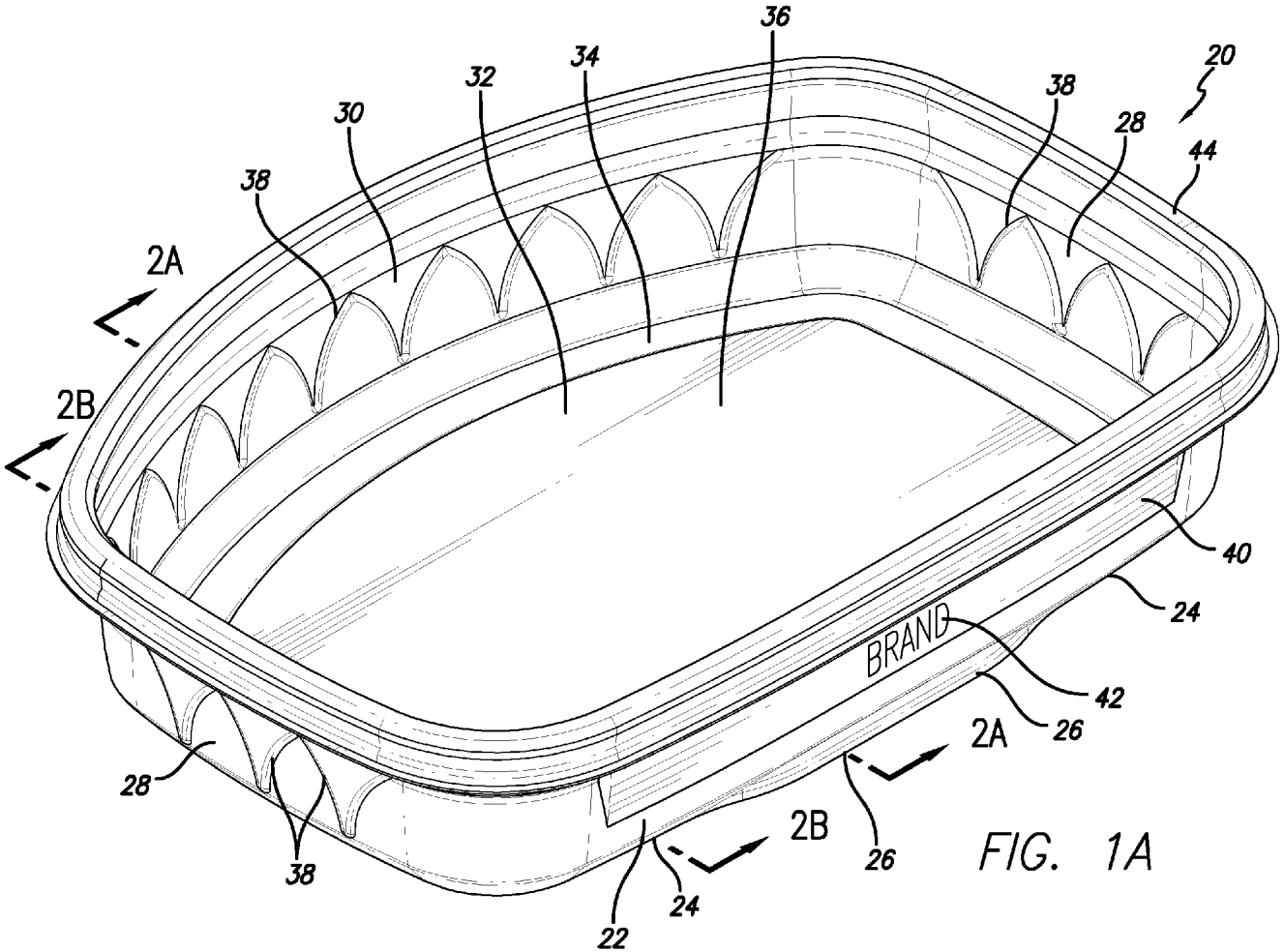
FIG. 1A is a perspective view of a tray for a container according to the invention.
Figure 1B:
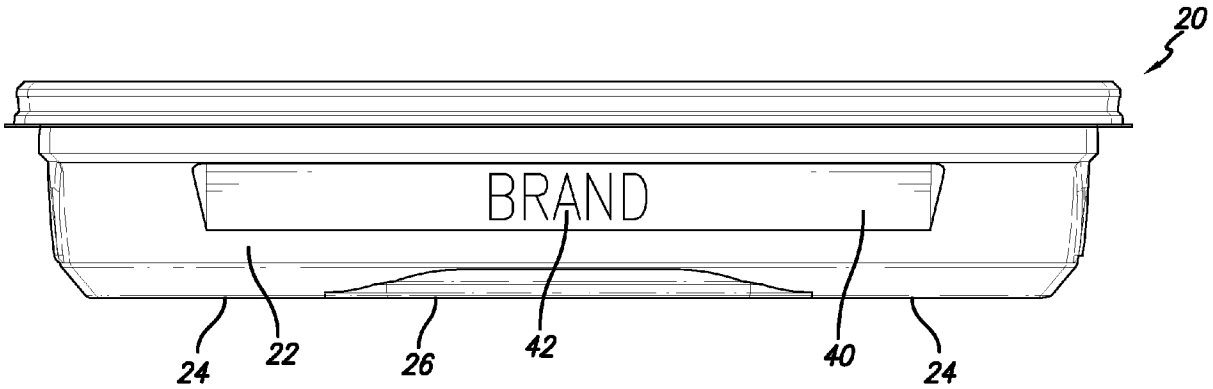
FIGS. 1B, 1C, 1D, 1E, and 1F are bottom, lateral, top, cavity, and rear side views, respectively, of the tray of FIG. 1A.
Figure 1C:
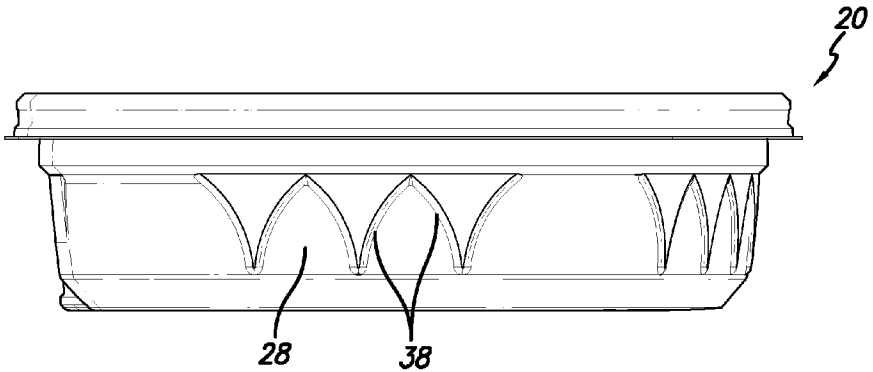
Figure 1D:
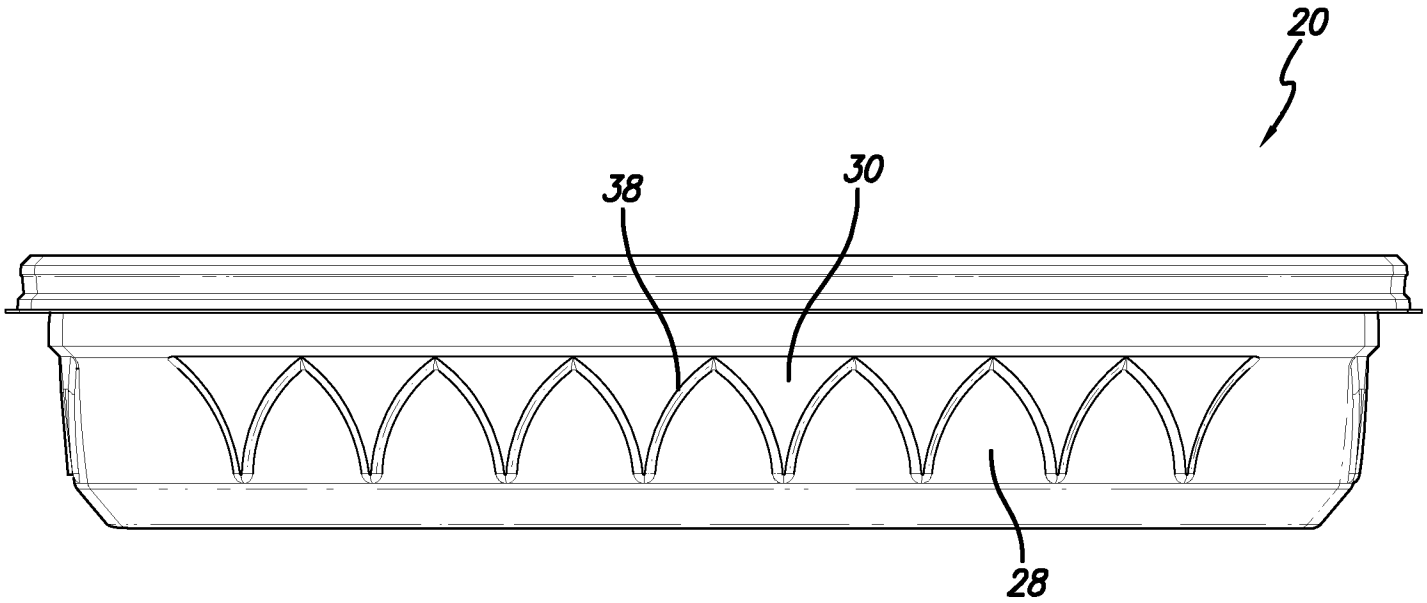
Figure 1E:
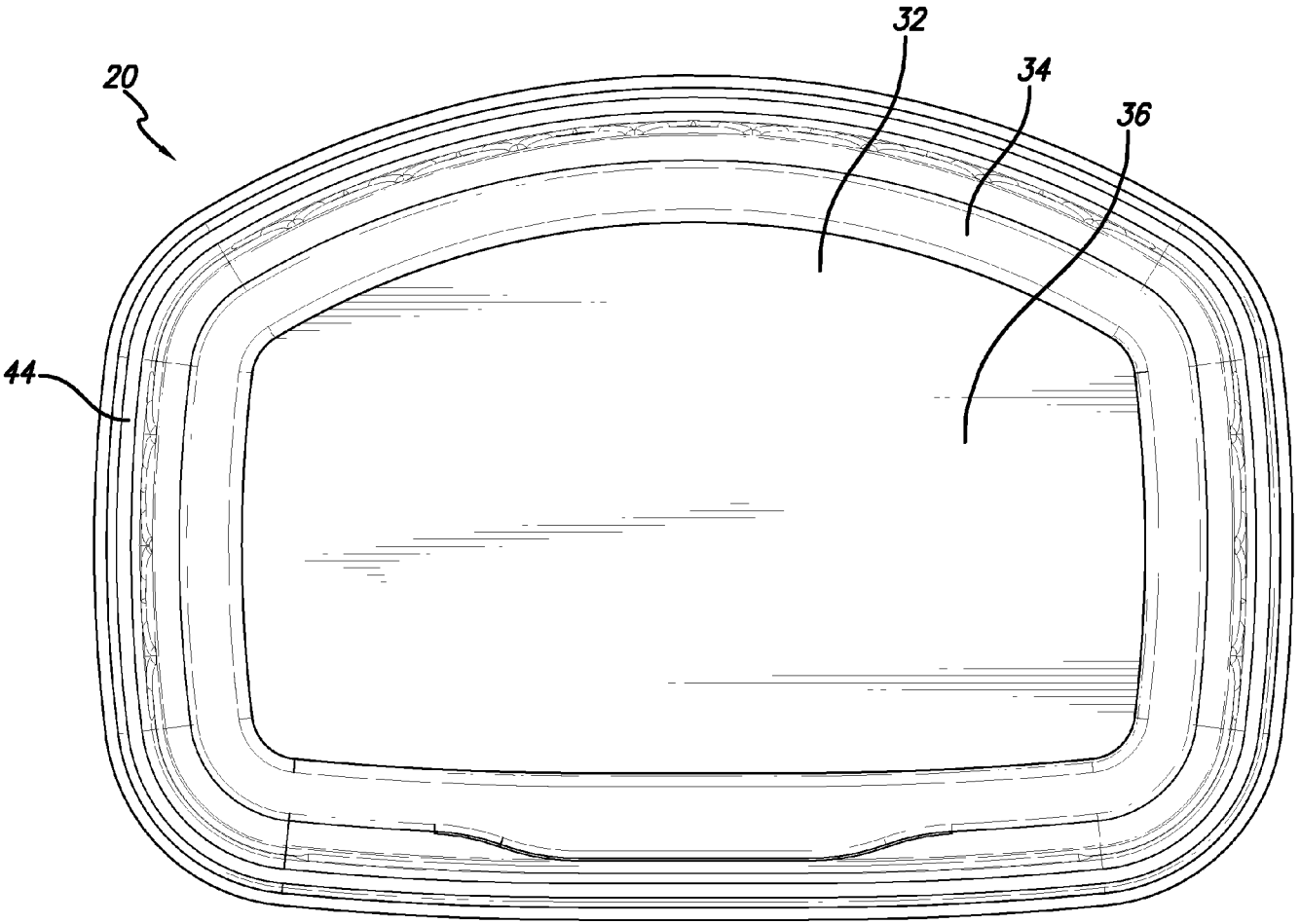
Figure 1F:
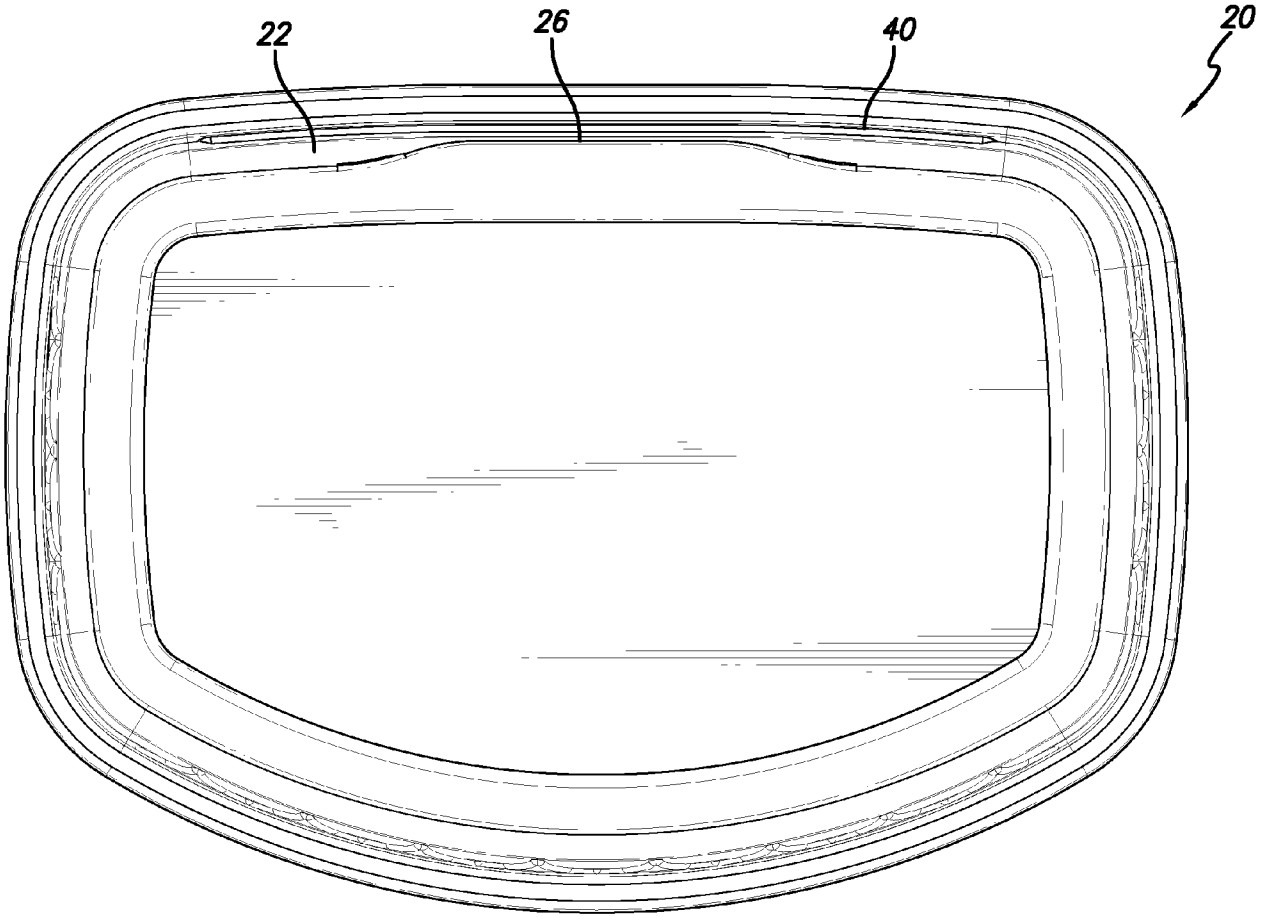
Figure 2A:
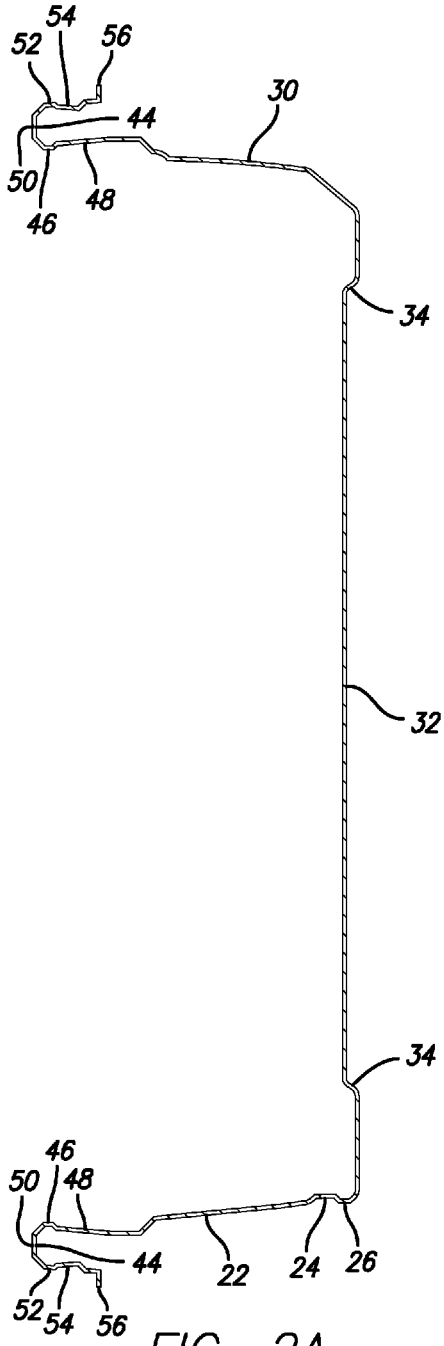
FIGS. 2A and 2B are cross-sections of the tray at lines 2A-2A and 2B-2B, respectively, in FIG. 1A.
Figure 8A:
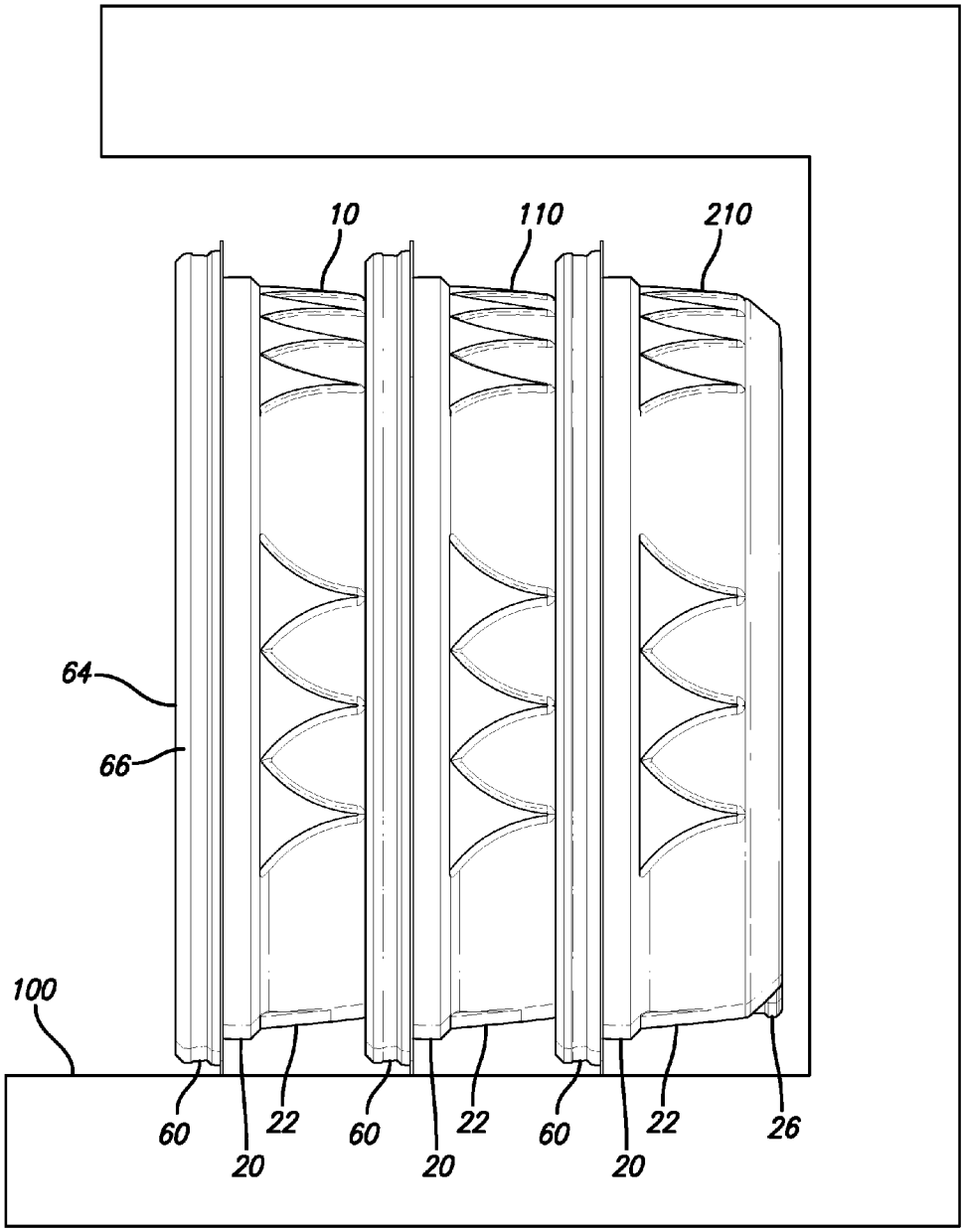
FIG. 8A is a side view of the three containers of FIG. 7 taken at line 8A-8A in FIG. 7.
Figure 8B:
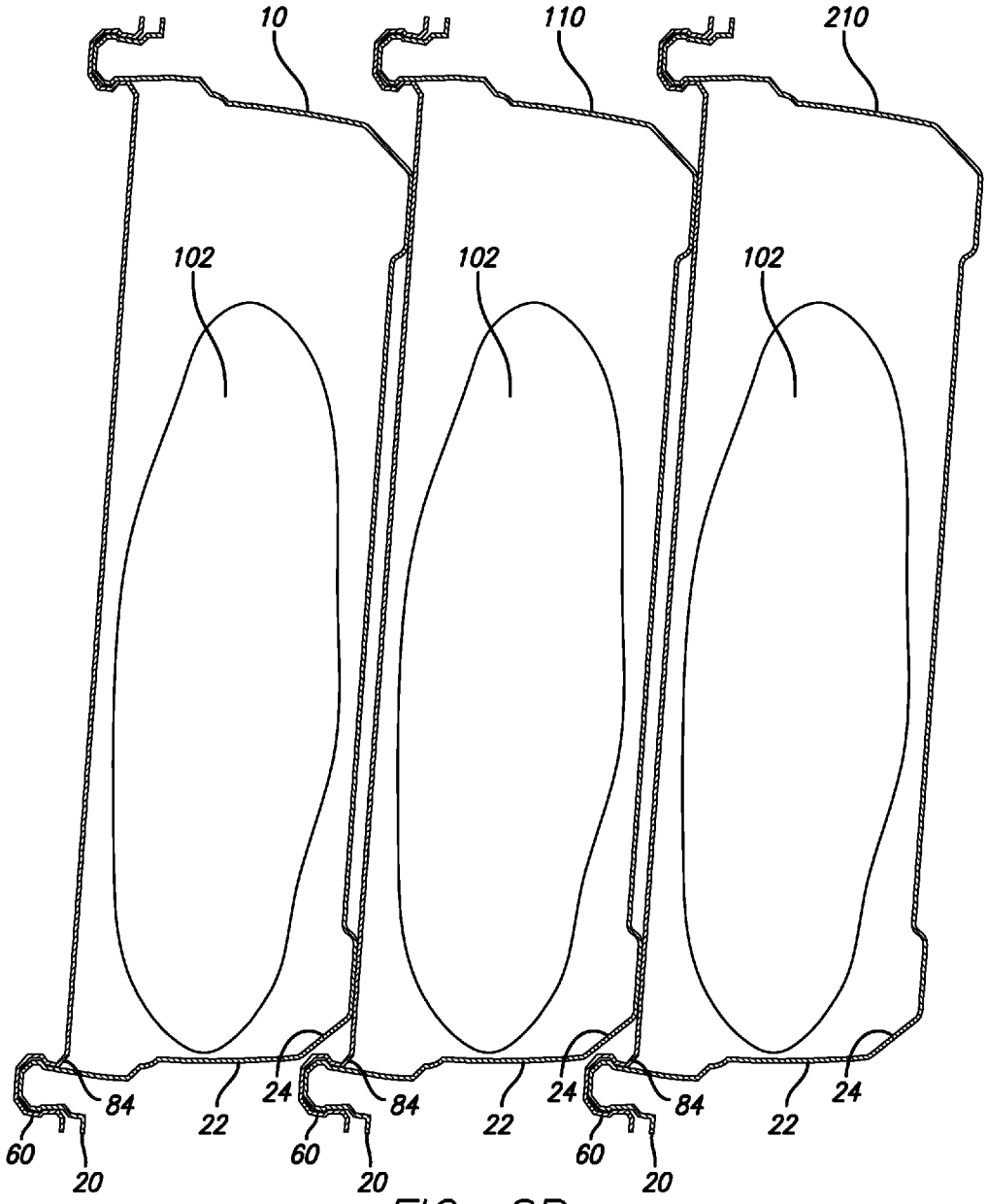
FIGS. 8B and 8C are cross-sections of the three containers of FIG. 7 at lines 8B-8B and 8C-8C, respectively, in FIG. 7.
Figure 8C:
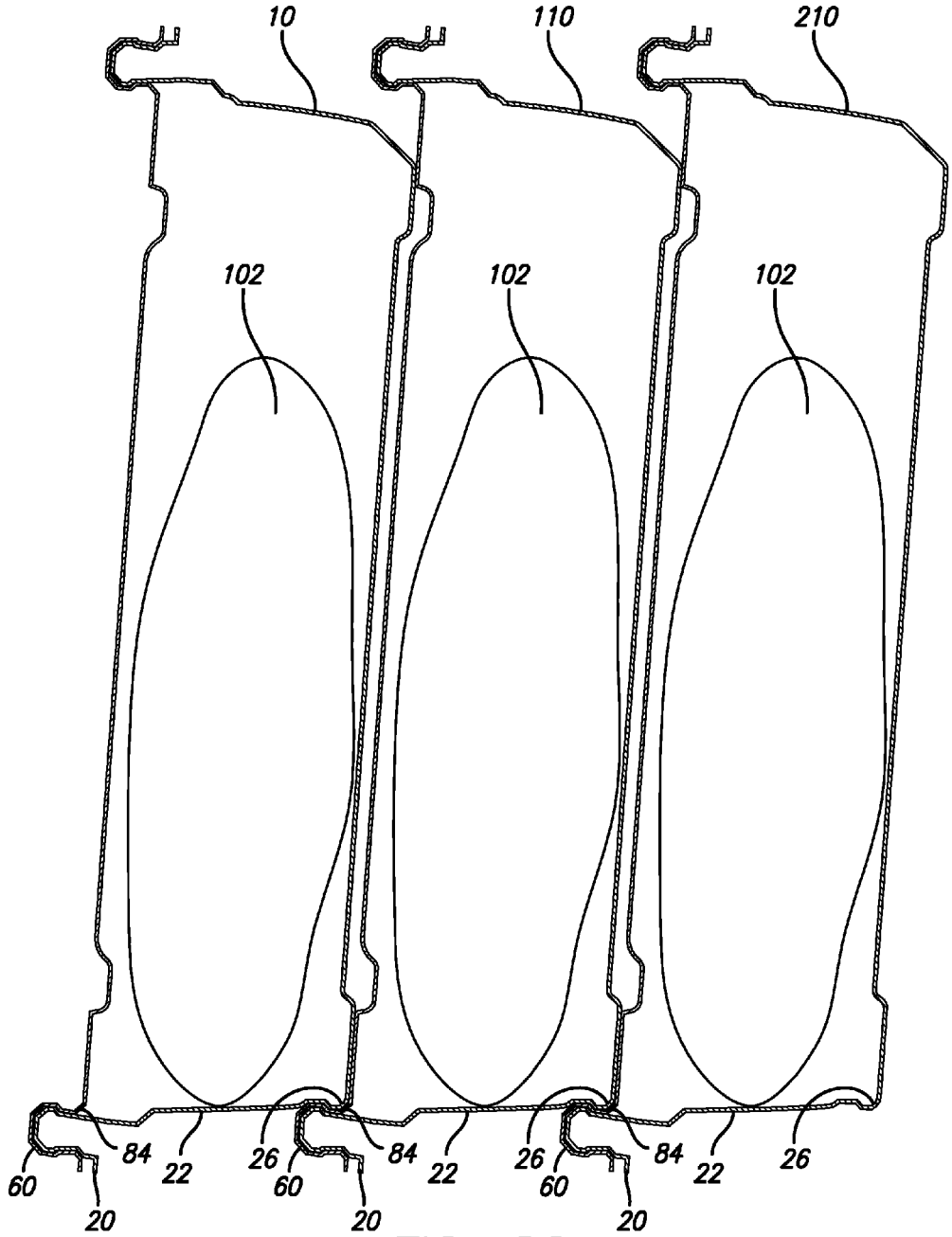

In the exemplary tray 20, the first engagement structure 26 is an inverted shelf with a rib or ridge, convex when viewed from outside the tray 20, that protrudes generally downwardly from the bottom rear corner 24 when the tray 20 is positioned with its bottom wall 22 facing down, as perhaps best shown in FIGS. 2A and 8C. However, this exact structure is not required and the first engagement structure could be a different structure, for example with another male or convex structure such as a post, pin, plug, bulge, bump, hump, pyramid, cube, nub, projection, protrusion, protuberance, knob, or a combination of these structures. Alternatively or in combination, the first engagement structure could include a complementary structure, for example a concave (female) structure such as a slot, channel, socket, hole, notch, pit, crater, dent, depression, impression, gap, hollow, pit, or pocket.

The rear wall 32 forms the bottom of the interior cavity 36, and may include one or more perimeter channels 34. Any of the walls may include one or more embossed wall features 38 for decoration or for structural purposes.

Any of the walls may also include one or more raised engravings 42, for example brand markings, informational messages, or decorations. The engravings 42 can be placed inside a frame 40 that preferably has a convex shape extends slightly outwardly from the wall on which it appears, creating a space behind the engraving 42. When two trays are nested together for storage or transport, engravings 42 on the top tray can extend into the space created behind the convex framed area 40 on the bottom tray, reducing the interference between the engravings 42 on the top tray and the inner sidewall of the bottom tray.

Figure 2B:
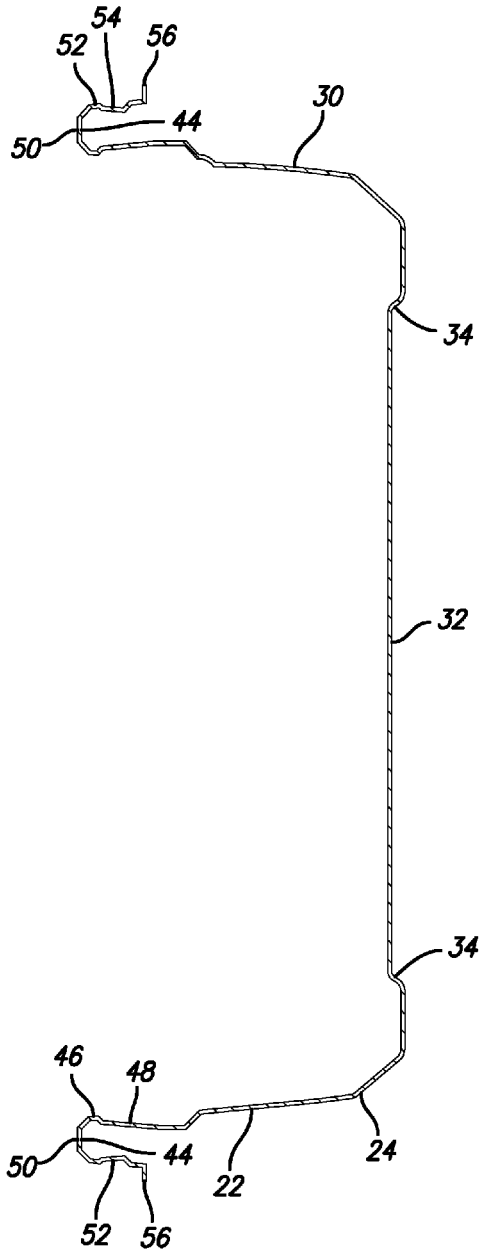
Figure 3A:
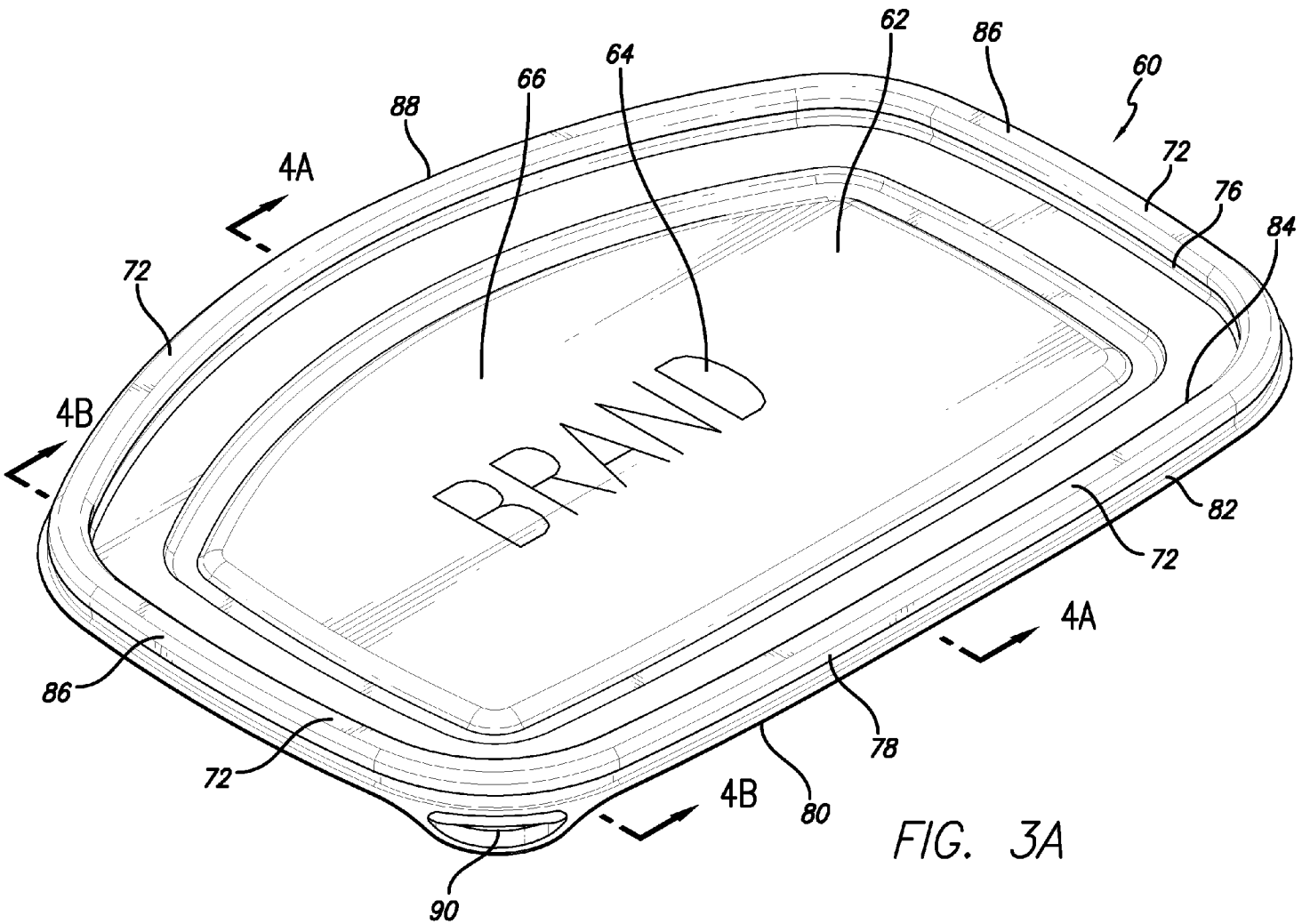
FIG. 3A is a perspective view of a lid for a container according to the invention.
Figure 3B:
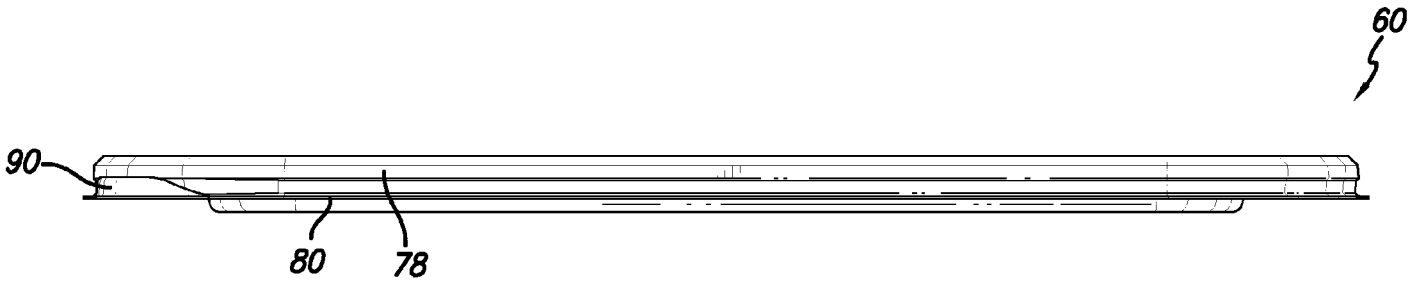
FIGS. 3B, 3C, 3D, 3E, 3F, and 3G are bottom, first lateral, second lateral, top, external (display) and internal (cavity) side views, respectively, of the lid of FIG. 3A.
Figure 3C:
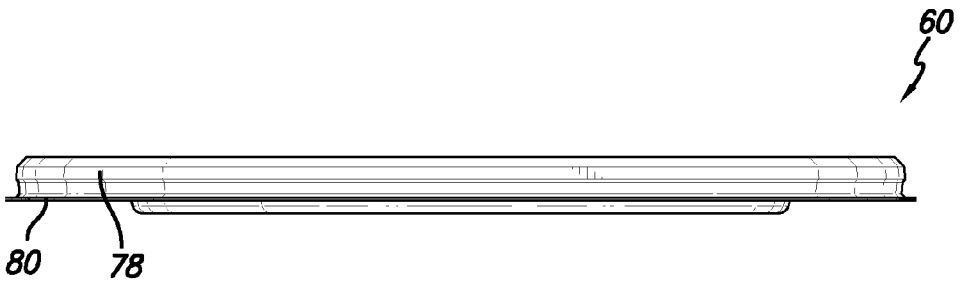
Figure 3D:
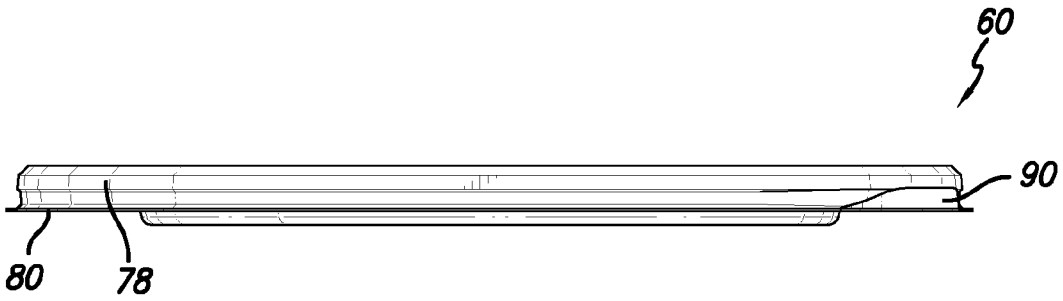
Figure 3E:
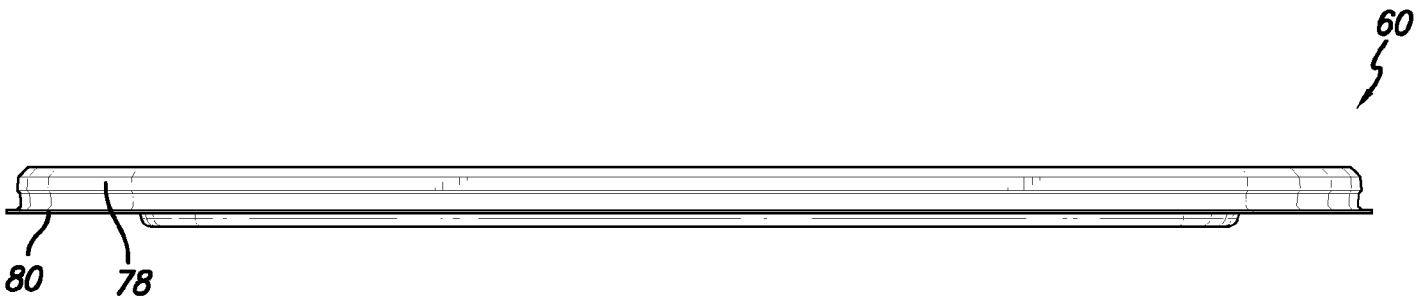
Figure 3F:
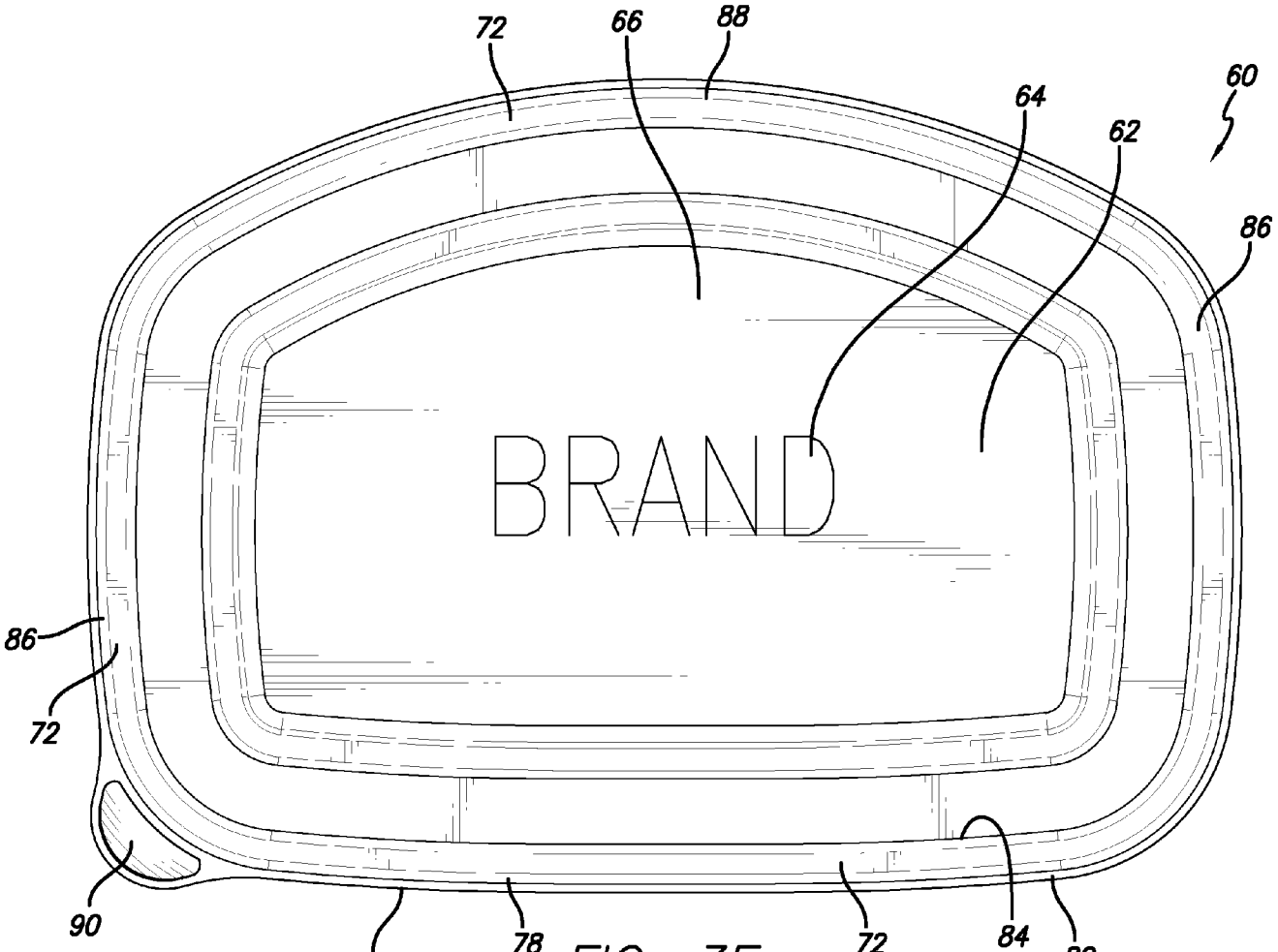
Figure 3G:
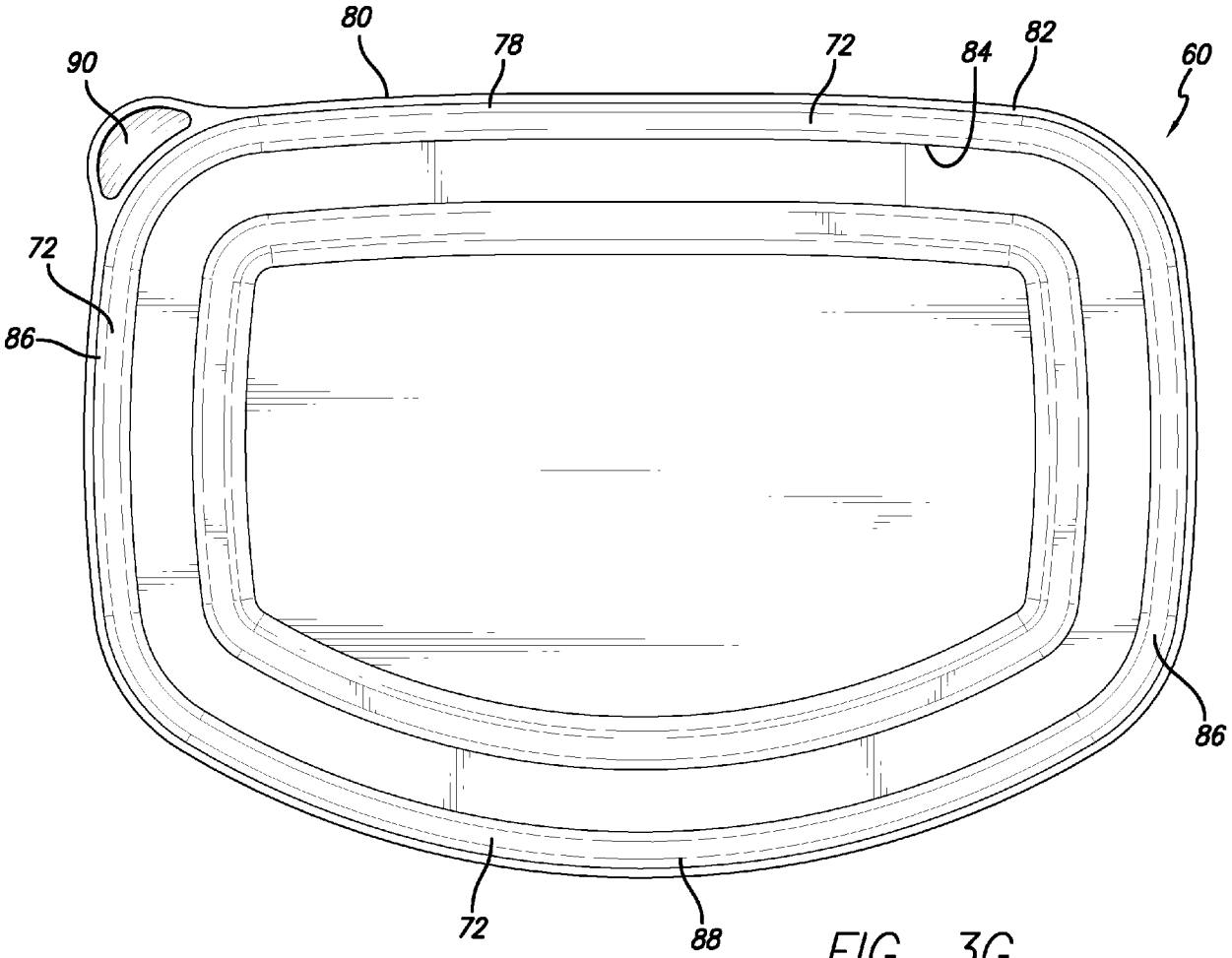

The bottom wall 22, side walls 28, and top wall 30 all terminate in a cavity rim 44 that forms the periphery of the interior cavity 36. As perhaps best shown in the cross-sections of FIGS. 2A and 2B, the cavity rim 44 includes an inside wall 46, a top surface 50, and an outside wall 52. The cavity rim 44 is preferably formed to include an inside wall taper 48 and outside wall taper 54 for mating with a corresponding taper on a lid, to improve the seal between the tray 20 and its lid. The rim 44 may also include an outside flange 56.

The exemplary tray 20 can have an interior cavity 36 that is about 1.5 inches deep from the top surface 50 of the rim 44 to the rear wall 22 that forms the bottom of the cavity 36. The tray 20 can be about 8 inches wide, from one side wall 28 to the other side wall 28, when the tray is positioned to stand vertically as in FIG. 7. The tray 20 can be about 5.5 inches tall, from the highest point above the top wall 30 to the bottom edge below the bottom wall 22, when the tray is positioned to stand vertically as in FIG. 7. However these exact dimensions are not required—the tray could be bigger or smaller, and/or could have different relative dimensions.

FIGS. 3A-3G provide various views of an exemplary lid 60 for a container according to the invention. For purposes of illustration, the names of the portions of the lid 60 (e.g. top, side, bottom, etc.) assume that the lid 60 is positioned to cover the cavity of a tray 20 in an upright standing position with the cavity of the tray facing the observer, in other words as shown in FIG. 7.

The lid 60 includes a central portion 62 surrounded by a bottom edge 82, two side edges 86, and a top edge 88. The central portion 62 may include engravings 64, such as brand markings, informational messages, or decorations. The lid 60 has an exterior surface 66 that faces outwardly when the lid 60 is fitted on a tray 20, and an interior surface 70 that faces the interior cavity 36 of the tray 20.

The bottom edge 82, two side edges 86, and top edge 88 form a perimeter sealing rim 72 that is shaped to mate with a complementary cavity rim 44 on a tray 20. As perhaps best seen in the cross-sections of FIGS. 4A and 4B, the perimeter sealing rim 72 includes a sealing slot 74 with an inside wall 76 and an outside wall 78. The perimeter sealing rim 72 may include a flange 80 extending outwardly from the outside wall 78. The lid 60 may include a removal tab 90 to facilitate removal of the lid 60 when it is mounted on a tray 20. The removal tab 90 can be placed on either side of the lid, preferably on a corner of the lid between the bottom edge 82 and a side edge 86.

The lid 60 includes a second engagement structure 84 that is configured to mate with the first engagement feature 26 of the tray 20, as perhaps best shown in FIG. 8C. In the exemplary lid 60, the second engagement structure 84 is located where the inside wall 76 of the sealing rim 72 meets the central portion of the lid 60, at a point near the bottom edge 82 of the lid. However, this particular location is not required and the second engagement structure could be located somewhere else, for example near a side edge 86 or central portion 60. FIGS. 3A, 3F, 4A, and 8C perhaps best illustrate the exemplary second engagement structure 84.

Figure 4A:
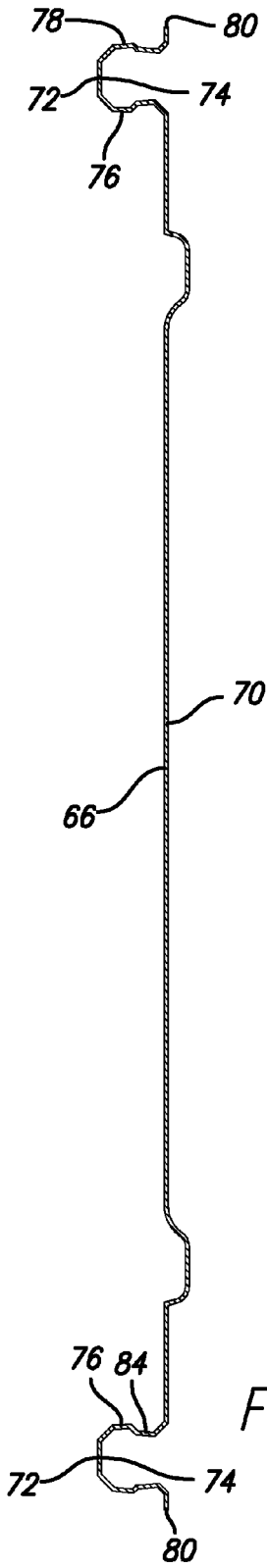
FIGS. 4A and 4B are cross-sections of the lid at lines 4A-4A and 4B-4B, respectively, in FIG. 3A.
Figure 4B:
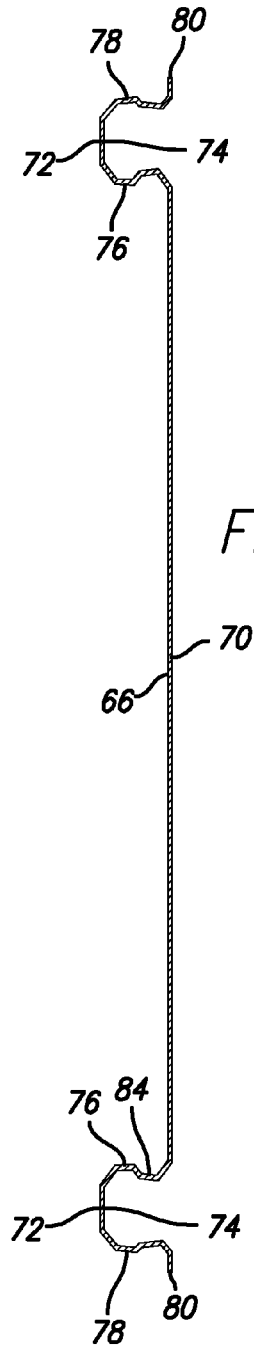

In the exemplary lid 60, the second engagement structure 84 is a shelf or prop with a slot or notch, concave when viewing the exterior side 66 of the lid 60, that opens generally upwardly in the inside wall 76 of the sealing rim, when the lid 60 is positioned with its bottom edge 82 down, as perhaps best shown in FIGS. 4A and 8C. However, this exact structure is not required and other complementary engagement structures could be used. For example, the second engagement structure could be a shelf or prop, or could include a different female or concave structure, such as a channel, socket, hole, notch, pit, crater, dent, depression, impression, gap, hollow, pit, or pocket. Alternatively or in combination, the second engagement structure could also include a complementary structure, for example a convex (male) structure such as a post, pin, plug, bulge, bump, hump, pyramid, cube, nub, projection, protrusion, protuberance, knob, or a combination of these structures.

The exemplary lid 60 is preferably sized to fit the tray 20. Like the tray 20, the lid 60 can be about 8 inches wide, from one side edge 86 to the other side edge 86, when the lid is positioned to stand vertically as in FIG. 7. Like the tray 20, the lid 60 can be about 5.5 inches tall, from the top edge 88 to the bottom edge 82. However, as with the tray, these exact dimensions are not required—the lid could be bigger or smaller, and/or could have different relative dimensions.

Figure 5:
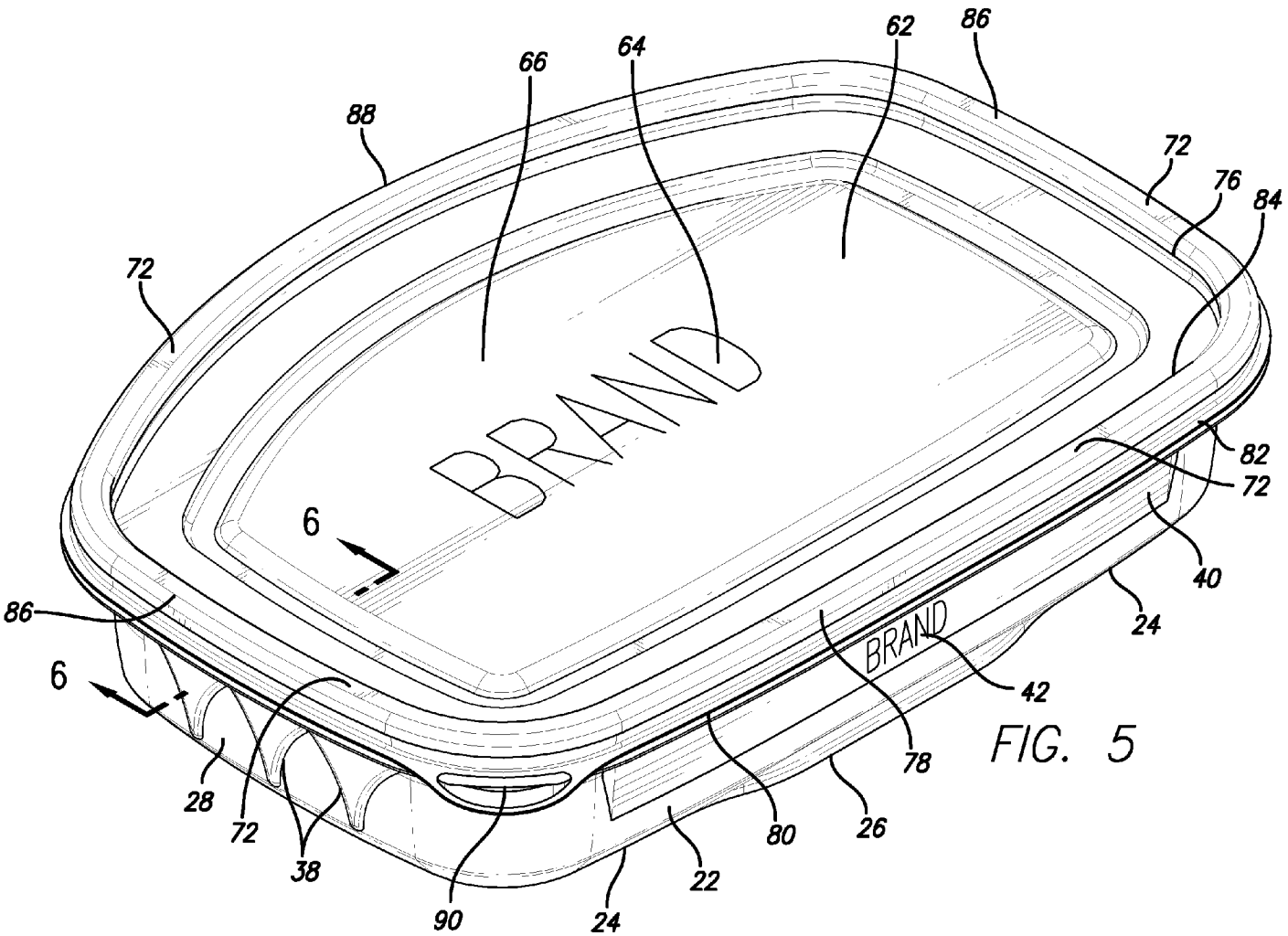
FIG. 5 is a perspective view of a container according to the invention comprising the lid of FIG. 3A on the tray of FIG. 1A.
Figure 6:
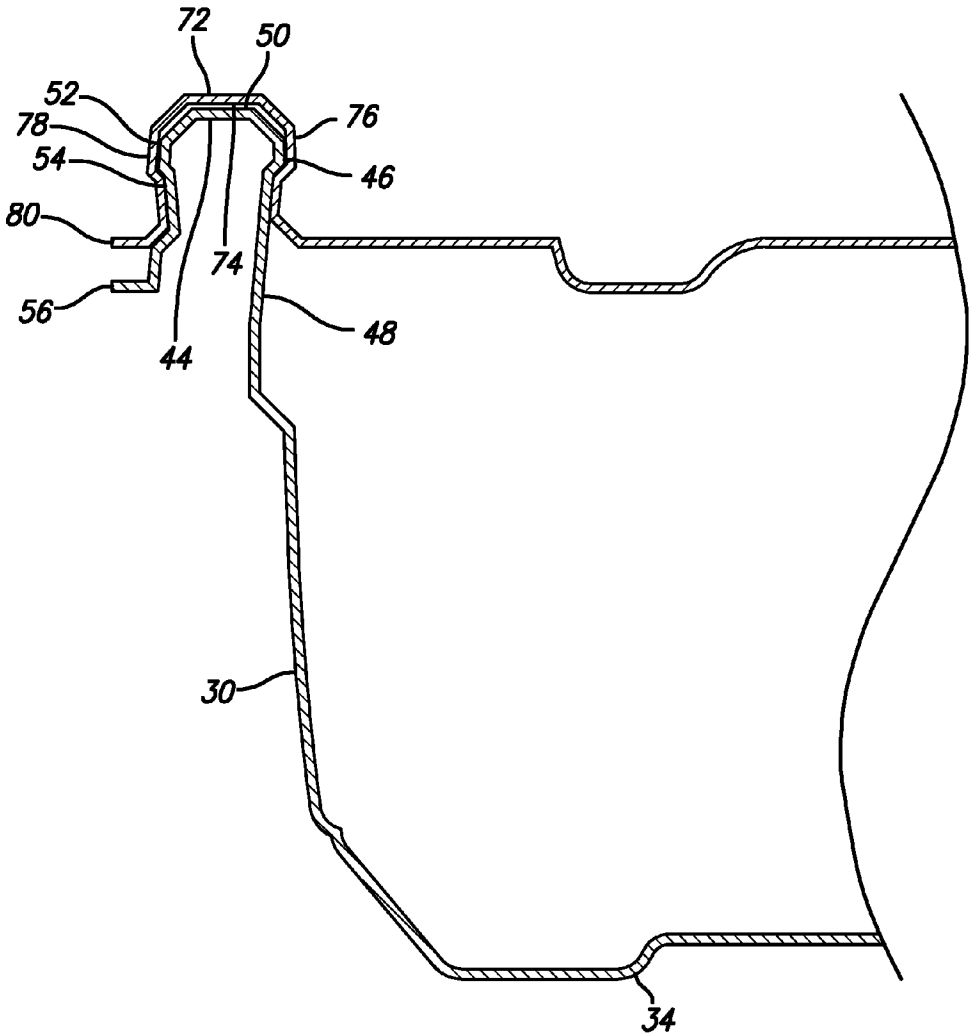
FIG. 6 is a cross-section of the container at line 6-6 in FIG. 5.

FIG. 5 is a perspective view of a container according to the invention comprising the lid 60 on the tray 20. The seal between the lid 60 and tray 20 is best illustrated in the cross-section view of FIG. 6, taken at line 6-6 in FIG. 5. As shown in FIG. 6, the inside wall 76 and outside wall 78 are preferably formed so that the sealing slot 74 on the lid has a tapered section that fits a matching tapered section on cavity rim 44 on the tray 20. This provides an interference fit that tends to keep the lid sealed on the tray unless deliberately opened by the consumer. The serpentine path through the seal between the lid and tray also helps to make the seal liquid-tight.

FIGS. 7 and 8A show a plurality of containers according to the invention, nested together and standing in a sales and display area 100 in a store, for example holding contents 102 (not shown in FIG. 7). If the contents 102 are deli meat products, the sales and display area 100 might be a refrigerated shelf. The exemplary plurality of containers includes three containers, a front container 10, a middle container 110, and a rear container 210. However, it should be understood that the plurality of nested containers could include a greater number of containers, or as few as two containers.

As perhaps best shown in the cross-section of FIG. 8C, the front container 10 and middle container 110 are nested together with the first engagement structure 26 of the tray 20 of the front container 10 mated with the second engagement structure 84 of the lid 60 of the middle container 110. The middle container 110 is nested together with the rear container 210.

It can be seen that any of the individual containers 10, 110, or 210 would not be stable if positioned in isolation to stand with the bottom wall 22 of the tray facing down and with the bottom edge of the container resting on a sales and display surface 100. For the same reason that a chair with only two legs cannot stand, a container 10 positioned as in FIG. 8C but in isolation (without containers 110 or 210) would tend to rotate in a clockwise direction about the pivot point formed by the bottom edge of the container and fall over onto the rear wall of the container.

Figure 9:
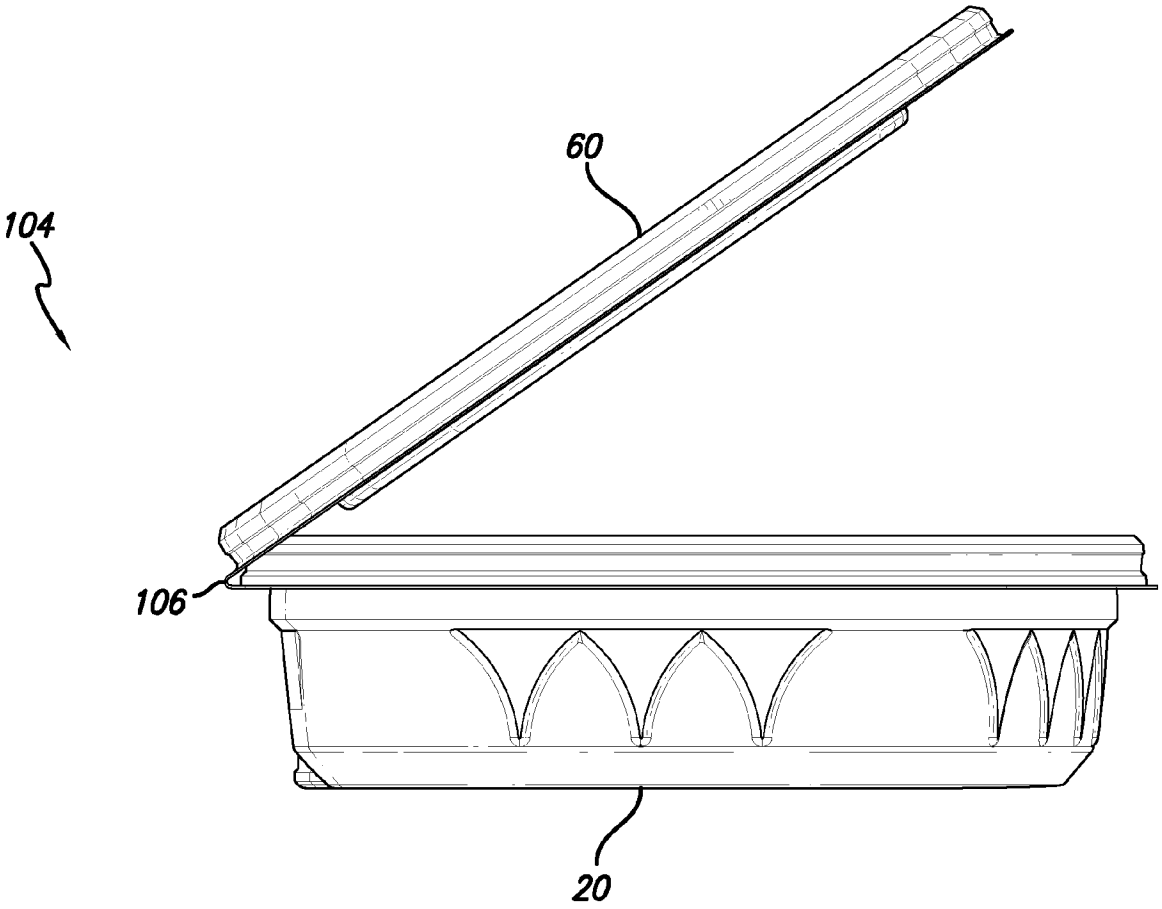
FIG. 9 is a side view of a unitary embodiment of a container according to the invention which includes a hinge connecting the lid to the tray.

In the exemplary containers 10, 110, and 210, the bottom edge of the container is formed by the outside wall flange 80 of the perimeter sealing rim 72 of the lid 60 at a point near the bottom edge 82 of the lid 60, together with the outside wall flange 56 of the cavity rim 44 of the tray 20 near the bottom wall 22 of the tray 20. However, this particular structure is not required and the bottom edge of the container could be formed in another way, for example by the cavity rim 44 of the tray and sealing rim 72 of the lid without any flanges or by a hinge 106 in a unitary package as shown in FIG. 9.

While the container 10 would be generally unstable When positioned to stand on its bottom edge in isolation, two or more containers nested together can stand on their bottom edges when they are engaged together, as perhaps best shown in FIG. 8C. Although the container 10 still tends to rotate in a clockwise fashion about its bottom edge, this rotation exerts a downward force on the first engagement structure 26 of container 10, where it is met by an equal and opposite upward force from the second engagement structure 84 of container 110 resulting in an equilibrium of forces that makes the nested containers more stable. This same basic principle of operation does not depend on the specific structures (male vs. female, etc.) used for the first engagement structure 26 and second engagement structure 84. Other functional structures, such as the alternatives discussed above with respect to first engagement structure 26 and second engagement structure 84, could be used to achieve the same result in the same way.

Nested together and engaged as shown in FIGS. 7 and 8A-8C, container 10 and 110 can stand on their edges with their bottom walls 22 facing down. In this orientation, the largest side of the containers, the exterior face 66 of the lid, is positioned to face the consumer. This maximizes the display area available no matter how many containers are in inventory. A configuration with more than two containers nested together, for example with containers 10, 110, and 210 nested together, works in basically the same way and can be even more stable.

While the preceding discussion of the exemplary container 10 uses particular embodiments of a tray 20 and lid 60, the invention could be practiced with other tray and lid configurations. The exemplary container 10 includes a single internal cavity 36, but this particular structure is not required. For example, a different number of cavities could be provided for particular applications, and the container as a whole or the individual cavities could be different sizes and/or shapes.

The tray 20 and lid 60 of the container 10 are preferably made using thermoforming methods, from a suitable thermoformable material. For example, a tray 20 and lid 60 meant for use with ready-to-eat foods might be formed of a thermoformable plastic such as oriented polystyrene (OPS), talc-filled polypropylene (TFPP), polypropylene (PP), high impact polystyrene (HIPS), polyethylene terepthalate (PET), amorphous PET (APET), crystalline polyethylene (CPET) polystyrene copolymer blends, styrene block copolymer blends, and the like.

The materials forming the tray 20 and lid 60 may be different, and those materials are not necessarily homogeneous, but may be, for example, a laminate, co-extruded material, or multilayer material. Additional components could be used, for example a plastic or foil membrane could be positioned on the tray 20 and covering the contents 102 in a way that allows the lid 60 to be fastened on the tray.

It is understood that the invention is not confined to the embodiments set forth herein as illustrative, but embraces all such forms thereof that come within the scope of the following claims.

What is claimed is:

1. A thermoformed container system comprising:

a forward container and a rear container, each container made of thermoformed plastic and comprising a tray and a lid mounted on the tray, the container having a bottom edge;

wherein the tray of the forward container has a bottom wall, a rear wall, and a top wall, wherein the bottom wall and the rear wall meet at a tray bottom rear corner, and the top wall and the rear wall meet at a tray top rear corner;

wherein the lid of the rear container has a lid bottom edge, a bottom sealing rim portion adjacent to the lid bottom edge with a bottom sealing rim inside wall adjoining a central portion of the lid of the rear container, a lid top edge, and a top sealing rim portion adjacent to the lid top edge with a top sealing rim inside wall adjoining the central portion; and wherein the tray of the forward container includes a first engagement structure that exerts a downward force met by an upward force from a second engagement structure on the lid of the rear container when the forward container and the rear container are nested together with the first engagement structure engaged with the second engagement structure;

whereby the forward container and the rear container are adapted to stand on their bottom edges when nested together; and wherein the first engagement structure is an inverted shelf located on the tray bottom rear corner.

2. The container system of claim 1 wherein the first engagement structure includes a rib protruding from the inverted shelf, wherein the rib is convex when viewed from outside the forward container.

3. The container system of claim 2 wherein the rib extends generally downwardly from the inverted shelf when the forward container is positioned with the bottom wall of the tray of the forward container facing down.

4. A thermoformed container system comprising:

a forward container and a rear container, each container made of thermoformed plastic and comprising a tray and a lid mounted on the tray, the container having a bottom edge;

wherein the tray of the forward container has a bottom wall, a rear wall, and a top wall, wherein the bottom wall and the rear wall meet at a tray bottom rear corner, and the top wall and the rear wall meet at a tray top rear corner;

wherein the lid of the rear container has a lid bottom edge, a bottom sealing rim portion adjacent to the lid bottom edge with a bottom sealing rim inside wall adjoining a central portion of the lid of the rear container, a lid top edge, and a top sealing rim portion adjacent to the lid top edge with a top sealing rim inside wall adjoining the central portion; and wherein the tray of the forward container includes a first engagement structure that exerts a downward force met by an upward force from a second engagement structure on the lid of the rear container when the forward container and the rear container are nested together with the first engagement structure engaged with the second engagement structure;

whereby the forward container and the rear container are adapted to stand on their bottom edges when nested together; and wherein the second engagement structure is a shelf located where the bottom sealing rim inside wall meets the central portion.

5. The container system of claim 4 wherein the second engagement structure includes a notch in the shelf, wherein the notch is concave when viewed from outside the rear container.

6. The container system of claim 5 wherein the notch opens generally upwardly when the rear container is positioned with the bottom wall of the tray of the rear container facing down.

7. A case pack, comprising a forward container and a rear container adapted to be nested together, each container made of thermoformed plastic and comprising a tray and a lid mounted on the tray to surround a product, each container having a bottom edge;

wherein the tray of the forward container has a bottom wall, a rear wall, and a top wall, wherein the bottom wall and the rear wall meet at a tray bottom rear corner, and the top wall and the rear wall meet at a tray top rear corner;

wherein the lid of the rear container has a lid bottom edge, a bottom sealing rim portion adjacent to the lid bottom edge with a bottom sealing rim inside wall adjoining a central portion of the lid of the rear container, a lid top edge, and a top sealing rim portion adjacent to the lid top edge with a top sealing rim inside wall adjoining the central portion;

wherein the tray of the forward container has a first engagement structure and the lid of the rear container has a second engagement structure;

wherein the first engagement structure exerts a force met by an equal and opposite force from the second engagement structure when the forward container and the rear container are positioned with their bottom edges down and with the tray of the forward container nested with the lid of the rear container to engage the first engagement structure with the second engagement structure;

whereby the forward container and the rear container are adapted to stand on their bottom edges when nested together; and wherein the first engagement structure is an inverted shelf located on the tray bottom rear corner.

8. The case pack of claim 7 wherein the first engagement structure includes a rib protruding from the inverted shelf, wherein the rib is convex when viewed from outside the forward container.

9. The case pack of claim 8 wherein the rib extends generally downwardly from the inverted shelf when the forward container is positioned with the bottom wall of the tray of the forward container facing down.

10. A case pack, comprising a forward container and a rear container adapted to be nested together, each container made of thermoformed plastic and comprising a tray and a lid mounted on the tray to surround a product, each container having a bottom edge;

wherein the tray of the forward container has a bottom wall, a rear wall, and a top wall, wherein the bottom wall and the rear wall meet at a tray bottom rear corner, and the top wall and the rear wall meet at a tray top rear corner;

wherein the lid of the rear container has a lid bottom edge, a bottom sealing rim portion adjacent to the lid bottom edge with a bottom sealing rim inside wall adjoining a central portion of the lid of the rear container, a lid top edge, and a top sealing rim portion adjacent to the lid top edge with a top sealing rim inside wall adjoining the central portion;

wherein the tray of the forward container has a first engagement structure and the lid of the rear container has a second engagement structure;

wherein the first engagement structure exerts a force met by an equal and opposite force from the second engagement structure when the forward container and the rear container are positioned with their bottom edges down and with the tray of the forward container nested with the lid of the rear container to engage the first engagement structure with the second engagement structure;

whereby the forward container and the rear container are adapted to stand on their bottom edges when nested together; and wherein the second engagement structure is a shelf located where the bottom sealing rim inside wall meets the central portion.

11. The case pack of claim 10 wherein the second engagement structure includes a notch in the shelf, wherein the notch is concave when viewed from outside the rear container.

12. The container system of claim 11 wherein the notch opens generally upwardly when the rear container is positioned with the bottom wall of the tray of the rear container facing down.

13. A method of retail sales comprising providing a sales and display space having a shelf area; and providing a forward container and a rear container, each container made of thermoformed plastic and comprising a tray and a lid mounted on the tray, each container having a bottom edge, wherein the tray of the forward container has a bottom wall, a rear wall, and a top wall, wherein the bottom wall and the rear wall meet at a tray bottom rear corner, and the top wall and the rear wall meet at a tray top rear corner;

wherein the lid of the rear container has a lid bottom edge, a bottom sealing rim portion adjacent to the lid bottom edge with a bottom sealing rim inside wall adjoining a central portion of the lid of the rear container, a lid top edge, and a top sealing rim portion adjacent to the lid top edge with a top sealing rim inside wall adjoining the central portion; and wherein the tray of the forward container has a first engagement structure and the lid of the rear container has a second engagement structure;

nesting the forward container with the rear container, with the first engagement structure engaged with the second engagement structure, and the first engagement structure exerting a force met by an equal and opposite force from the second engagement structure;

whereby the forward container and the rear container are adapted to stand on their bottom edges when nested together; and wherein the first engagement structure is an inverted shelf located on the tray bottom rear corner.

14. The method of claim 13 wherein the first engagement structure includes a rib protruding from the inverted shelf, wherein the rib is convex when viewed from outside the forward container.

15. The method of claim 14 wherein the rib extends generally downwardly from the inverted shelf when the forward container is positioned with the bottom wall of the tray facing down.

16. A method of retail sales comprising providing a sales and display space having a shelf area; and providing a forward container and a rear container, each container made of thermoformed plastic and comprising a tray and a lid mounted on the tray, each container having a bottom edge, wherein the tray of the forward container has a bottom wall, a rear wall, and a top wall, wherein the bottom wall and the rear wall meet at a tray bottom rear corner, and the top wall and the rear wall meet at a tray top rear corner;

wherein the lid of the rear container has a lid bottom edge, a bottom sealing rim portion adjacent to the lid bottom edge with a bottom sealing rim inside wall adjoining a central portion of the lid of the rear container, a lid top edge, and a top sealing rim portion adjacent to the lid top edge with a top sealing rim inside wall adjoining the central portion; and wherein the tray of the forward container has a first engagement structure and the lid of the rear container has a second engagement structure;

nesting the forward container with the rear container, with the first engagement structure engaged with the second engagement structure, and the first engagement structure exerting a force met by an equal and opposite force from the second engagement structure;

whereby the forward container and the rear container are adapted to stand on their bottom edges when nested together; and wherein the second engagement structure is a shelf located where the bottom sealing rim inside wall meets the central portion.

17. The method of claim 16 wherein the second engagement structure includes a notch in the shelf, wherein the notch is concave when viewed from outside the rear container.

* * * * *